US005097649A

United States Patent [19]

Ueda et al.

[11] Patent Number: 5,097,649

[45] Date of Patent: Mar. 24, 1992

[54] PACKAGING MACHINE

[75] Inventors: Kazuo Ueda; Shigeru Wakabayashi; Yasuji Fujikawa, all of Tokushima, Japan

[73] Assignee: Shikoku Kakoki Co., Ltd., Tokushima, Japan

[21] Appl. No.: 689,583

[22] Filed: Apr. 23, 1991

[30] Foreign Application Priority Data

Apr. 24, 1990 [JP] Japan ..... 2-44203[U]

[51] Int. Cl.[5] ..... B65B 55/24

[52] U.S. Cl. ..... 53/167; 53/565; 493/123; 493/125

[58] Field of Search ..... 493/123, 125, 313, 165; 53/167, 393, 563, 564, 565; 15/306.1, 309.2

[56] References Cited

U.S. PATENT DOCUMENTS

| | | | |
|---|---|---|---|
| 2,644,188 | 7/1953 | Pacilio | 15/309.2 X |
| 3,373,552 | 3/1968 | Scherr | 15/309.2 X |
| 3,649,993 | 3/1972 | Sauer | 15/309.2 X |
| 4,590,734 | 5/1986 | Ueda | 53/167 X |
| 4,590,740 | 5/1986 | Rodocker | 53/167 X |
| 4,670,936 | 6/1987 | Hanson | 15/309.2 |
| 4,683,701 | 8/1987 | Rangwala et al. | 53/167 |
| 4,708,707 | 11/1987 | Koike et al. | 493/313 |
| 4,776,830 | 10/1988 | Fujikawa et al. | 493/125 X |
| 4,788,811 | 12/1988 | Kawajiri et al. | 53/167 X |

*Primary Examiner*—Robert L. Spruill
*Assistant Examiner*—Daniel B. Moon
*Attorney, Agent, or Firm*—Armstrong, Nikaido, Marmelstein, Kubovcik & Murray

[57] ABSTRACT

A packaging machine comprising a rotary body having blank bottom forming radial mandrels so arranged as to be successively stoppable at a plurality of process stations including a blank feed station, a feeder for fitting a tubular blank having a square or rectangular cross section around the mandrel stopping at the blank feed station to feed the blank to the mandrel, and a collector for collecting paper particles adhering to the blank to be fed by the feeder. The feeder has a pair of guide rails positioned on opposite sides of and extending in parallel to a phantom line extending outward from the mandrel stopping at the blank feed station. The collector has a tubular collecting cover enclosing the guide rails. The cover is formed with an air outlet covered with a filter. A suction device applies suction to the air outlet.

4 Claims, 3 Drawing Sheets

PACKAGING MACHINE

BACKGROUND OF THE INVENTION

The present invention relates to packaging machines, and more particularly to a packaging machine for use with paper blanks.

Packaging machines of the type mentioned are adapted for use with blanks which are folded flat so as to be unfoldable to a tubular form having a square or rectangular cross section. Such blanks have adhered thereto paper particles produced during the production of blanks and are unsanitary if these particles are left unremoved.

The blank folded flat is unfolded to a tubular form of square to rectangular cross section by a feeder. The paper particles adhering to the blank are most liable to scatter upon unfolding. Accordingly, packaging machines are known wherein a suction blower is provided in the vicinity of the blank feeder for collecting paper particles.

The conventional packaging machine is adapted to collect paper particles scattering in the air but is unable to completely collect paper particles as deposited on blanks.

SUMMARY OF THE INVENTION

The main object of the present invention is to provide a packaging machine which is free of the above problem.

The packaging machine of the present invention comprises a rotary body having blank bottom forming radial mandrels so arranged as to be successively stoppable at a plurality of process stations including a blank feed station; a feeder for fitting a tubular blank having a square or rectangular cross section around the mandrel stopping at the blank feed station to feed the blank to the mandrel, the feeder having a pair of guide rails positioned on opposite sides of and extending in parallel to a phantom line extending outward from the mandrel stopping at the blank feed station; and a collector for collecting paper particles adhering to the blank to be fed by the feeder, the collector having a tubular collecting cover enclosing the guide rails and formed with an air outlet, a filter covering the air outlet and suction means for applying suction to the air outlet.

With the packaging machine of the present invention, a flow of air occurs inside the collecting cover, and the paper particles adhering to the blank being transported through the collecting cover are forcibly separated off the blank by the flow, whereupon the separated paper particles are attracted to the filter. Thus, the paper particles can be collected reliably and efficiently.

DESCRIPTION OF THE PREFERRED EMBODIMENT

An embodiment of the present invention will be described below with reference to the drawings.

In the following description, the term "front" refers to the direction in which containers advance by being transported by a conveyor (left-hand side of FIG. 3), and the term "rear" to the opposite direction.

Figure 3:
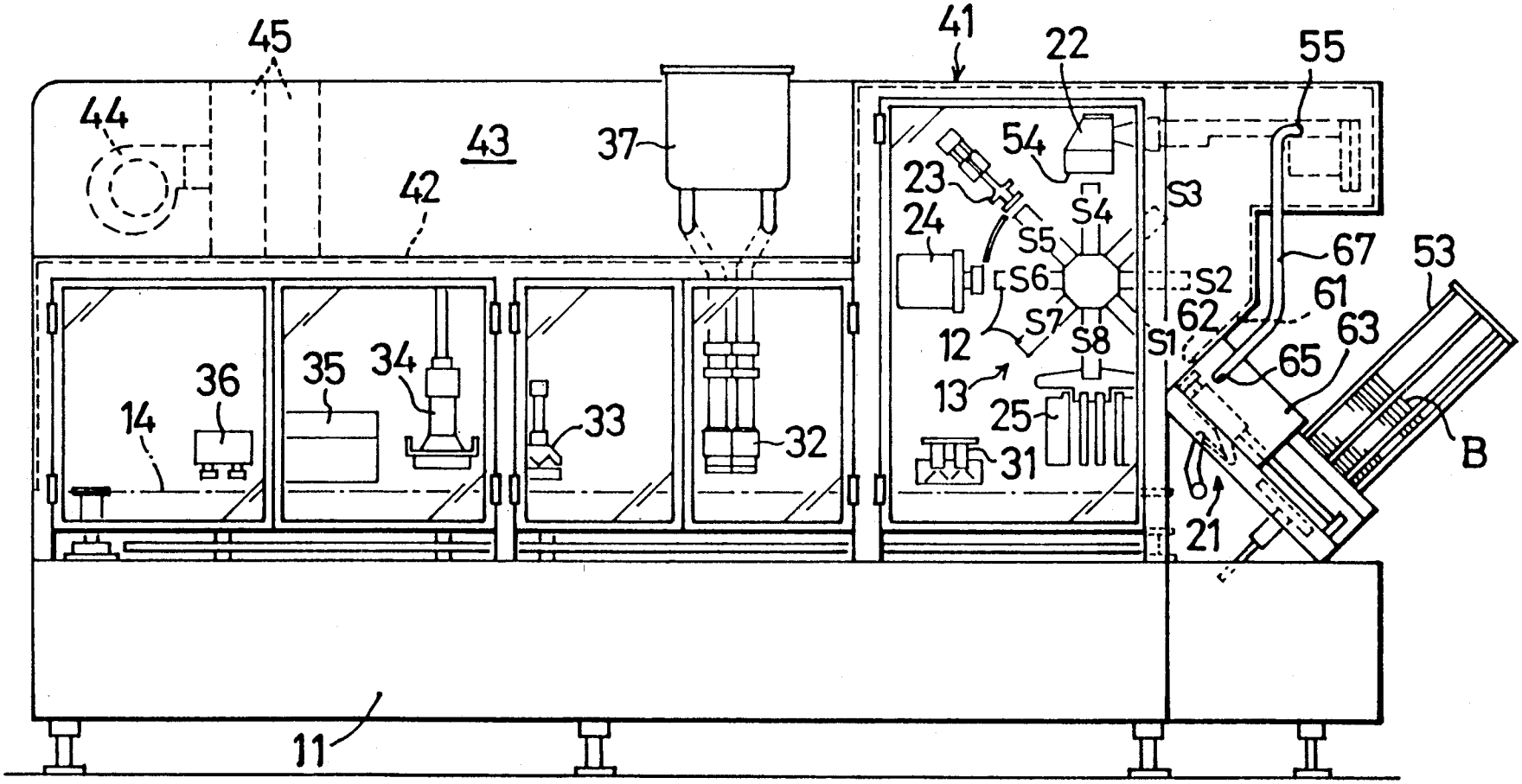
FIG. 3 is a side elevation schematically showing a packaging machine in its entirety.

The illustrated packaging machine is adapted to produce sealed containers of paper each in the form of a box, having a gabled roof and filled with contents. With reference to FIG. 3, the machine comprises an intermittently driven rotary body 13 disposed above the rear end of a bed 11 and having eight radial mandrels 12, and a container transport conveyor 14 providing a path of transport, the starting end of which is positioned immediately below the rotary body 13.

The mandrels 12 stop at each of the eight stations to be described below successively. The eight stations are a feed station S1, two idle stations S2, S3, a bottom heating station S4, a bottom break station S5, a bottom press station S6, an idle station S7 and a container removing station S8. A feeder 21 is disposed at the feed station S1, a bottom heating hot air blower 22 at the bottom heating station S4, a bottom breaker 23 at the bottom break station S5, a bottom press 24 at the bottom press station S6, and a container removing device 25 at the container removing station S8.

On the other hand, arranged along the container transport path in the direction of from its rear end toward the front end thereof are a preliminary top breaker 31, filling device 32, primary top breaker 33, top heater 34, top sealing device 35 and branding device 36.

Provided on the top side of the bed 11 is a clean booth 41 in the form of a box left open at its bottom side. Although there is a clearance between the top of the bed 11 and the bottom of the clean booth 41 for clean air to flow out therethrough, the rotary body 13 and the conveyor 14 are entirely enclosed in the clean booth, and the above group of devices except for the feeder 21 and the filling device 32 are also entirely covered with the booth 41. The feeder 21 in its entirety is provided outside the booth 41, and a filling liquid tank 37 only of the filling device 32 is positioned outside the booth 41. The upper portion of the interior of the booth 41 except where the rotary body 13 is disposed is separated off by a partition wall 42 to provide a clean air supply chamber 43. A fan 44 and filters 45 are accommodated in the chamber 43. Although not shown, clean air inlets are formed at required portions of the partition wall 42.

The devices of the foregoing group are all well known and therefore will not be described in detail, but the blank feeder 21 and the hot air blower 22 will be described briefly.

The blank feeder 21 comprises a stacker 53 disposed obliquely above a phantom line extending outward from the mandrel 12 as stopped at the feed station S1 for accommodating a multiplicity of blanks B folded flat and stacked up, a pair of guide rails 51 positioned on opposite sides of and extending in parallel to the phantom line, a suction member 71 movable through the space between the guide rails 51 toward and away from the stacker 53 for withdrawing the blanks B one by one, unfolding each blank B into a square to rectangular tube and causing the guide rails 51 to hold the tube, a reciprocating member 73 slidable on a guide rod 72 extending in parallel to the guide rails 51, and a movable pusher 52 and a fixed pusher 74 attached to the reciprocating member 73 for pushing the blank B inward along the guide rails 51 to transport the blank to the feed station S1 and fitting the blank B around the mandrel 12 stopping at the station to feed the blank to the mandrel.

The bottom heating hot air blower 22 has a discharge opening 54 and an intake opening 55. Inside the clean booth 41, the discharge opening 54 is opposed to the outer end of the mandrel 12 as stopped at the bottom heating station S4.

The mandrel 12 stopping at the feed station S1 is obliquely oriented rearwardly downward at an angle of 45 degrees with a horizontal line. The rear side wall of the clean booth 41 has approximately at the middle portion of its height a slanting wall 61 intersecting the phantom line extending outward from the mandrel 12 at right angles therewith. The slanting wall 61 has a blank inlet 62. Attached to the wall 61 in communication with the blank inlet 62 is the inner end of a cover 63 for collecting the paper particles adhering to blanks. The collecting cover 63 is inclined at the same angle as the mandrel 12.

Figure 1:
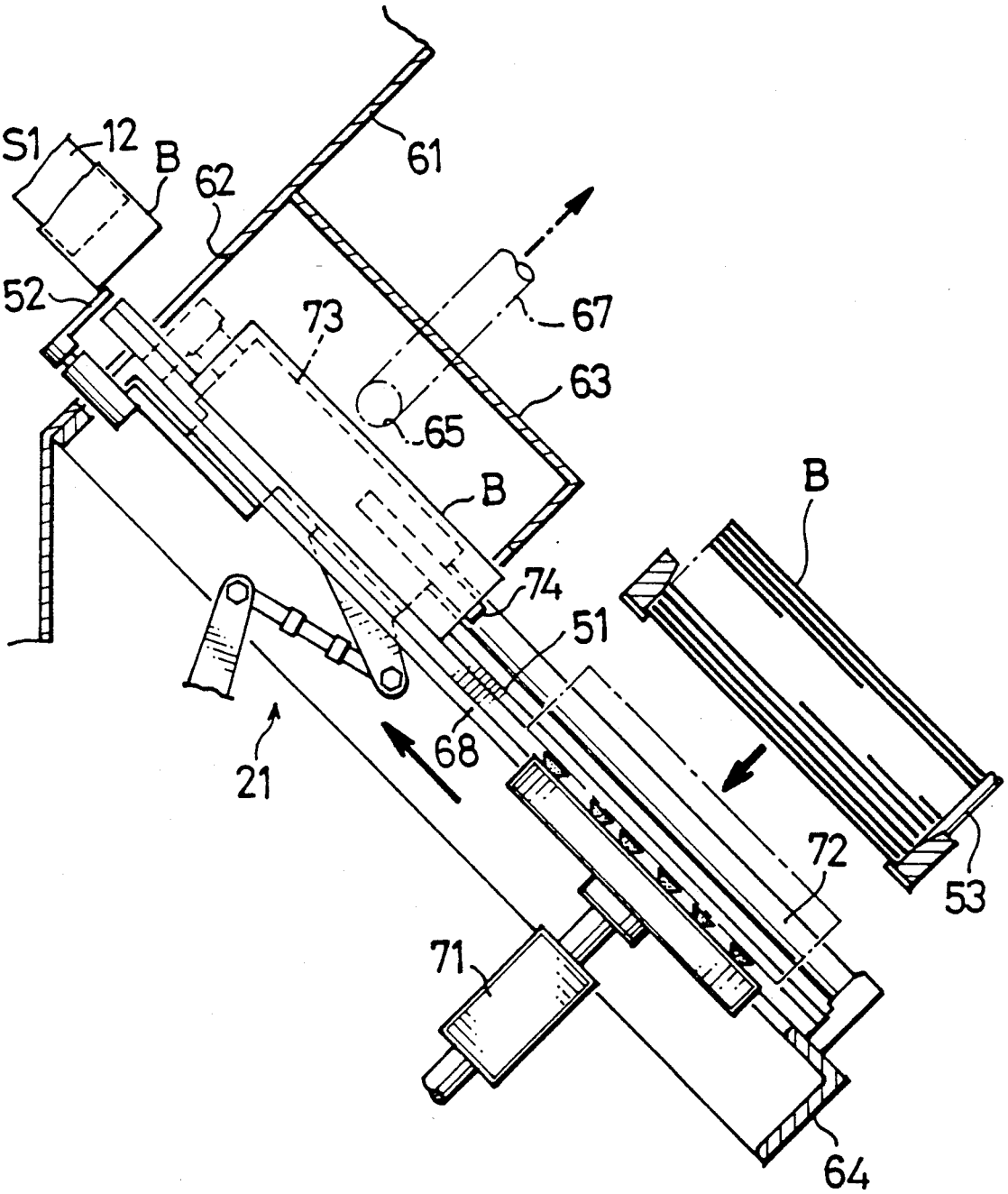
FIG. 1 is a view in longitudinal section of a paper particle collector.
Figure 2:
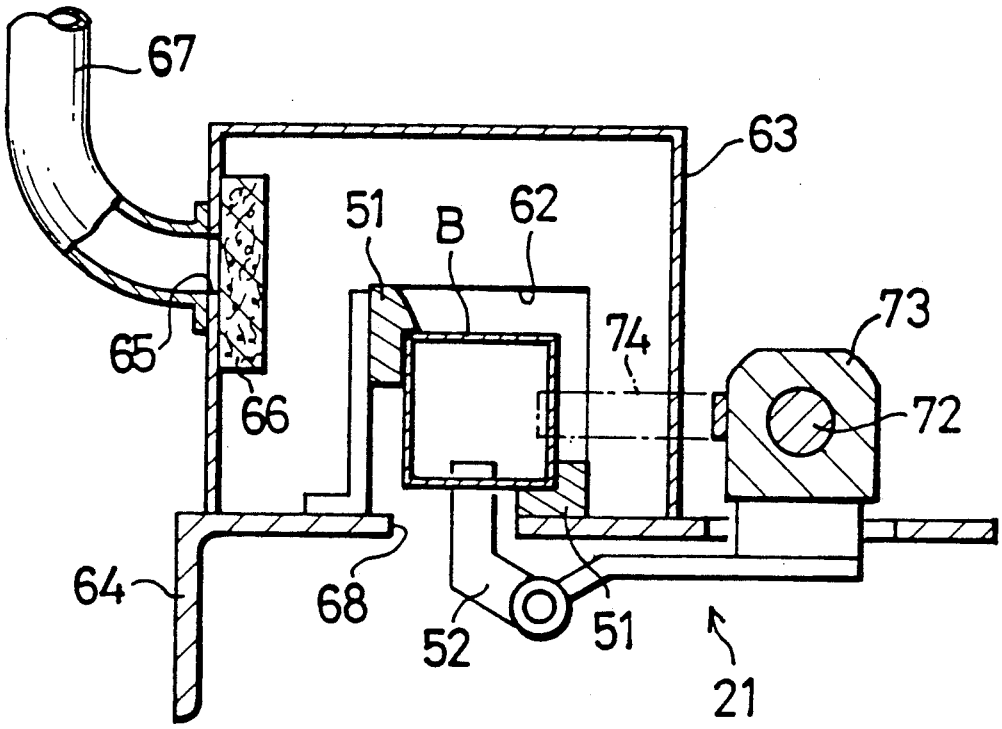
FIG. 2 is a view in cross section of the collector.

With reference to FIGS. 1 and 2, the collecting cover 63 forms a tube along with a frame 64. The frame 64 is formed with a slit 68, through which the movable pusher 52 extends into the collecting cover 63. An air outlet 65 is formed in one side wall of the collecting cover 63. A filter 66 is attached to the inner surface of the same side wall of the cover 63 to cover the air outlet 65. A suction hose 67 has one end communicating with the air outlet 65 and the other end in communication with the intake opening 55 of the hot air blower 22 (see FIG. 3).

Although the hot air discharged from the opening 54 of the blower 22 is used primarily for heating the bottom of the blank B, the air inside the clean booth 41 is also heated with the hot air. By the suction applied by the suction hose 67 to the interior of the collecting cover 63, the heated air within the clean booth 41 is drawn off through the blank inlet 62, led into the collecting cover 63 and discharged from the air outlet 65 after flowing through the cover 63. On the other hand, the blank B is transported through the collecting cover 63 by the feeder 21. At this time, the paper particles adhering to the blank B are forcibly separated off by the flow of air through the collecting cover 63, whereupon the separated particles are attracted to the filter 66. The air drawn into the intake opening 55 through the suction hose 67 is heated again and then delivered from the discharge opening 54.

As described above, the clean air within the clean booth 41 is heated by the blank bottom heating hot air blower 22 and then drawing into the intake opening 55 of the blower 22 by way of the collecting cover 63 and the suction hose 67. This assures the hot air blower 22 of a high thermal efficiency and lower running cost.

Further since there is no need to provide a suction blower exclusively for the collection of paper particles, the equipment is less costly.

While the invention has been particularly shown and described in reference to preferred embodiments thereof, it will be understood by those skilled in the art that changes in form and details may be made therein without departing from the spirit and scope of the invention.

What is claimed is:

1. A packaging machine comprising:

a rotary body having blank bottom forming radial mandrels so arranged as to be successively stoppable at a plurality of process stations including a blank feed station;

a feeder for fitting a tubular blank having a square or rectangular cross section around a mandrel when the mandrel is stopped at the blank feed station to feed the blank to the mandrel, the feeder having a pair of guide rails for guiding the blank to the mandrel; and a collector for collecting paper particles adhering to the blank to be fed by the feeder, the collector having a tubular collecting cover enclosing the guide rails and formed with an air outlet, a filter covering the air outlet and suction means for applying suction to the air outlet, wherein the suction means includes a suction hose connecting the air outlet of the collecting cover in communication with an intake opening of a blank bottom heating hot air blower.

2. A packaging machine as defined in claim 1, wherein the blank bottom heating hot air blower includes a discharge opening an the intake opening is disposed at one of the process stations downstream from the blank feed station.

3. A packaging machine comprising:

a rotary body having blank bottom forming radial mandrels so arranged as to be successively stoppable at a plurality of process stations including a blank feed station;

a clean booth enclosing the rotary body and having a blank inlet at a portion thereof;

a feeder for fitting a tubular blank having a square or rectangular cross section around a mandrel when the mandrel is stopped at the blank feed station to feed the blank to the mandrel by transporting the blank inward through the blank inlet into the clean booth; and a collector for collecting paper particles adhering to the blank before the blank is transported into the clean booth, the collector having a tubular collecting cover connected at its inner end to the blank inlet and formed with an air outlet, a filter covering the air outlet and suction means for applying suction to the air outlet, wherein the suction means includes a suction hose connecting the air outlet of the collecting cover in communication with an intake opening of a blank bottom heating hot air blower.

4. A packaging machine as defined in claim 3, wherein the blank bottom heating hot air blower includes a discharge opening and the intake opening is disposed at one of the process stations downstream from the blank feed station, the discharge opening being positioned inside the clean booth.

* * * * *